US008434265B1

(12) United States Patent
Campbell et al.

(10) Patent No.: US 8,434,265 B1
(45) Date of Patent: May 7, 2013

(54) RACK GEAR OPERATOR

(76) Inventors: Frank W. Campbell, Lake Elmo, MN (US); John J. Micinski, Rockford, IL (US)

( * ) Notice: Subject to any disclaimer, the term of this patent is extended or adjusted under 35 U.S.C. 154(b) by 303 days.

(21) Appl. No.: 12/399,168

(22) Filed: Mar. 6, 2009

(51) Int. Cl.
*E05D 15/30* (2006.01)
*E05D 15/42* (2006.01)
*E05D 7/04* (2006.01)

(52) U.S. Cl.
USPC ..... 49/250; 49/246; 49/248; 49/257; 49/260; 16/195

(58) Field of Classification Search ..... 49/246–250, 49/257–260; 16/195, 201, 359; 24/272; 74/10.39; 81/359
See application file for complete search history.

(56) References Cited

U.S. PATENT DOCUMENTS

| | | | | | |
|---|---|---|---|---|---|
| 577,484 | A * | 2/1897 | Mase | 49/247 |
| 952,503 | A * | 3/1910 | Brenner | 49/125 |
| 1,576,785 | A * | 3/1926 | Putnam | 49/252 |
| 1,592,972 | A * | 7/1926 | Farnsworth | 246/128 |
| 1,990,300 | A * | 2/1935 | Miller | 312/409 |
| 3,838,537 | A * | 10/1974 | Stavenau et al. | 49/248 |
| 4,226,002 | A * | 10/1980 | Davis | 16/273 |
| 4,253,276 | A * | 3/1981 | Peterson et al. | 49/249 |
| 4,301,622 | A * | 11/1981 | Dunsmoor | 49/342 |
| 4,555,829 | A * | 12/1985 | Davis | 16/342 |
| 5,050,345 | A * | 9/1991 | Nakanishi | 49/279 |
| 5,775,028 | A * | 7/1998 | Lambert | 49/248 |
| 5,815,984 | A * | 10/1998 | Sheets et al. | 49/246 |
| 5,839,229 | A * | 11/1998 | Briggs et al. | 49/246 |
| 5,964,011 | A * | 10/1999 | Ruston et al. | 16/239 |
| 6,161,336 | A * | 12/2000 | Ziv-Av | 49/260 |
| 6,442,898 | B1 * | 9/2002 | Wu | 49/246 |
| 6,644,884 | B2 * | 11/2003 | Gledhill | 403/317 |
| 7,047,600 | B2 * | 5/2006 | Muir | 16/366 |
| 2003/0110701 | A1 * | 6/2003 | Dawson | 49/246 |
| 2004/0128914 | A1 * | 7/2004 | Hempelmann | 49/192 |
| 2005/0055804 | A1 * | 3/2005 | Liang et al. | 16/235 |
| 2006/0218864 | A1 * | 10/2006 | Blomqvist | 49/248 |
| 2007/0020091 | A1 * | 1/2007 | Giaimo et al. | 415/160 |
| 2007/0020092 | A1 * | 1/2007 | Giaimo et al. | 415/160 |
| 2011/0068124 | A1 * | 3/2011 | Reynolds et al. | 222/145.1 |

* cited by examiner

*Primary Examiner* — Katherine Mitchell
*Assistant Examiner* — Marcus Menezes
(74) *Attorney, Agent, or Firm* — IPLM Group, P.A.

(57) ABSTRACT

A window operator moves a sash between an open and closed position. The window operator includes a track member and a sliding member. A gear member has a second end adapted and configured to be operatively connected to the window sash and a first end has a plurality of radially spaced gear members. A rack member is positioned proximate the track and is positioned to engage the gear teeth. One of the gear members and rack member is operatively connected to the sliding member. The other is positioned proximate the track and has no longitudinal movement relative to the track. A drive member is connected to the sliding member, wherein actuation of the drive member moves the sliding member longitudinally and causes the gear teeth to engage the track, thereby resulting in rotational movement of a gear member to move the sash between an open and closed position.

12 Claims, 9 Drawing Sheets

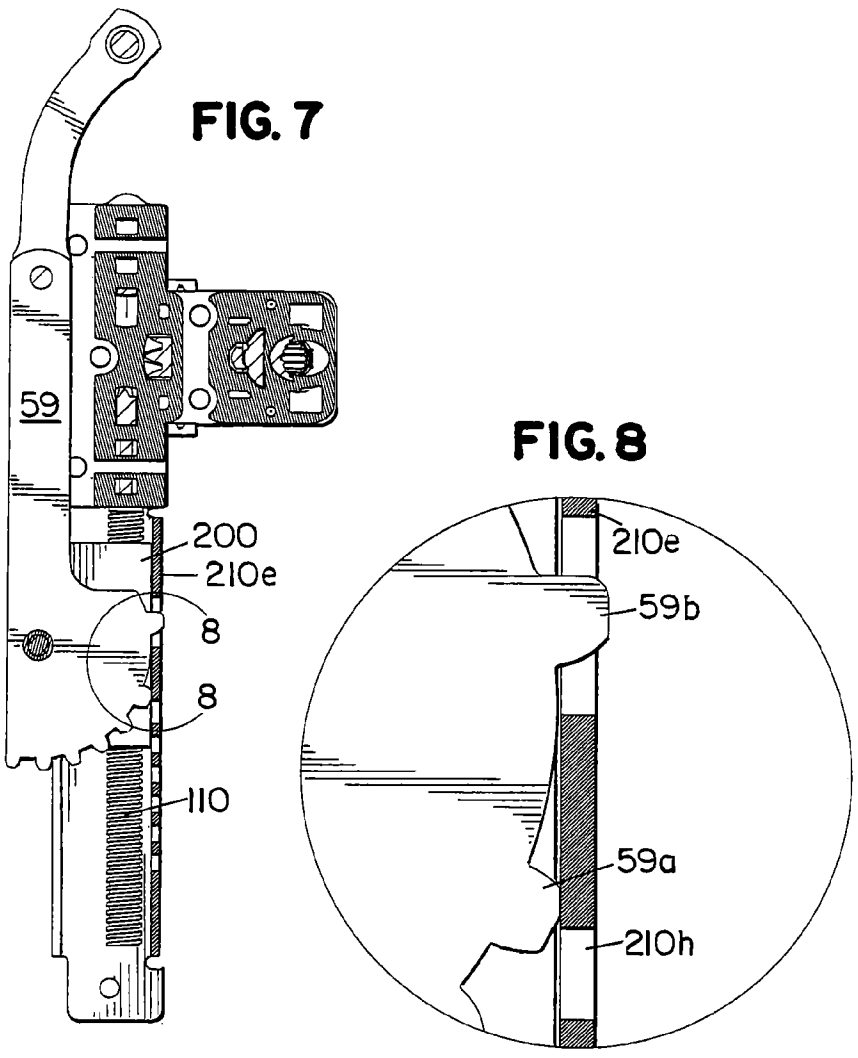
FIG. 7
FIG. 8
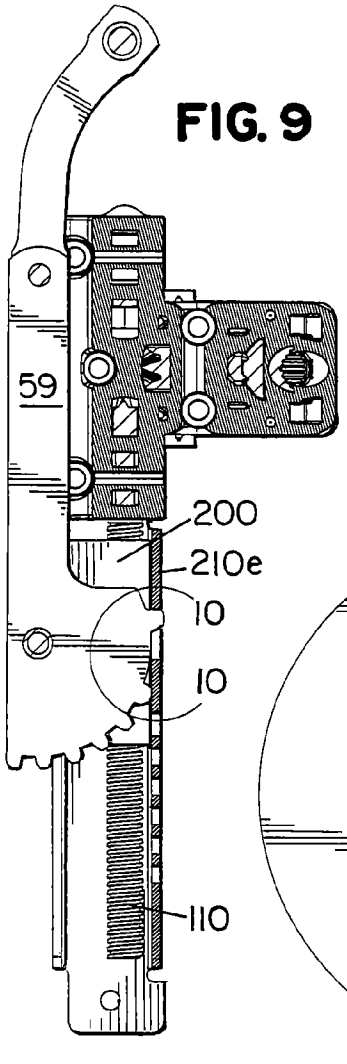
FIG. 9
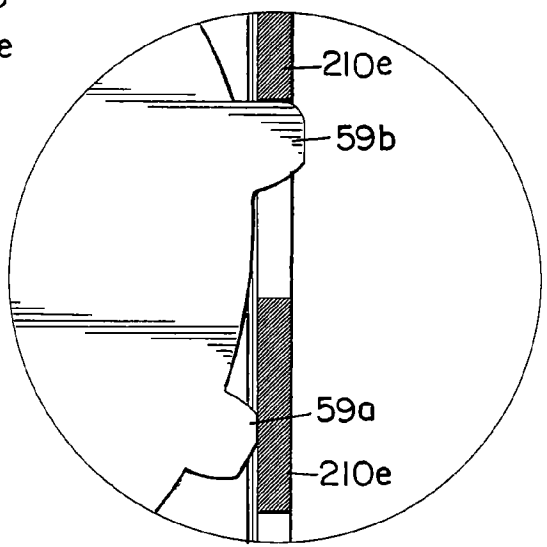
FIG. 10

RACK GEAR OPERATOR

BACKGROUND OF THE INVENTION

1. Field of the Invention

This invention relates generally to a window operator and more particularly to a window operator that utilizes a rack and gear.

2. Description of the Prior Art

Most modern casement window utilizes a rotary actuator that may be used to open or close a window sash. The actuator may be in the form of a hand crank adapted to be turned in one direction to open the sash and in the opposite direction to close the sash. There are also instances where the actuator is operable by an electric motor.

There have been many types of actuators that have been utilized in the past. However, there has always been room for improvement and changes over the existing window operators.

The present invention addresses problems associated with the prior art and provides for an improved window operator.

SUMMARY OF THE INVENTION

In one embodiment, the invention is a window operator for moving a window sash between an open and closed position relative to a fixed window frame. The window operator has a track member and a sliding member positioned for longitudinal movement along the track member. A gear member is operatively connected to the sliding member, the gear member has a first end and a second end, the second end adapted and configured to be operatively connected to a window sash, the first end has a plurality of radially spaced gear teeth. A rack member is positioned proximate to the track and positioned to engage the gear teeth. A drive member is operatively connected to the sliding member, wherein actuation of the drive member moves the sliding member longitudinally causing the gear teeth to engage the rack, thereby resulting in rotational movement of the gear member to move a sash between an open and closed position.

In another embodiment, the invention is a lead screw window operator for moving a sash between an open and closed position relative to a fixed window frame. The window operator has a track member and a sliding member positioned for longitudinal movement along the track member. The sliding member has a threaded longitudinal bore. A gear member is operatively connected to the sliding member. The gear member has a first end and a second end, the second end adapted and configured to be connected to a window sash, the first end having a plurality of radially spaced gear teeth. A rack member is operatively connected to the track and positioned to engage the gear teeth. A lead screw has an outer screw thread, the screw thread is positioned in the threaded bore of the sliding member. The lead screw has a first end adapted and configured to be rotated by a gear assembly, wherein rotating the lead screw moves the sliding member longitudinally causing the gear teeth to engage the rack, thereby resulting in rotational movement of the gear member to move a sash between an open and closed position.

In another embodiment, the invention is a window operator for moving a window sash between an open and closed position relative to a fixed window frame. The window operator has an operator housing configured and adapted to be mounted to the window frame. A sliding member is positioned for longitudinal movement relative to the operator housing. A gear member is pivotally mounted relative to the operator housing. The gear member has a first end and a second end, the second end adapted and configured to be operatively connected to a window sash, the first end having a plurality of radially spaced gear teeth. A rack member is carried by the sliding member and positioned to engage the gear teeth. A drive member is operatively connected to the sliding member, wherein actuation of the drive member moves the sliding member longitudinally causing the rack to engage the gear teeth, thereby resulting in rotational movement of the gear member to move a sash between an open and closed position.

In another embodiment, the invention is a window operator for moving a window sash between an open and closed position relative to a fixed window frame. The window operator has a track member. A sliding member is positioned for longitudinal movement along the track member. A gear member has a first end and a second end. The second end is adapted and configured to be operatively connected to a window sash, the first end having a plurality of radially spaced gear teeth. A rack member is positioned proximate to the track and positioned to engage the gear teeth. One of the gear member and rack member is operatively connected to the sliding member, the other of the gear member and rack member is positioned proximate the track and having no longitudinal movement relative to the track. A drive member is operatively connected to the sliding member, wherein actuation of the drive member moves the sliding member longitudinally causing the gear teeth to engage the rack, thereby resulting in rotational movement of the gear member to move a sash between an open and closed position.

BRIEF DESCRIPTION OF THE DRAWINGS

FIG. 7 is a view of the window operator shown in FIG. 3, in a third position;

FIG. 8 is an enlarged view of section 8-8 shown in FIG. 7;

FIG. 9 is a view of the window operator shown in FIG. 3, shown in a fourth position;

FIG. 10 is an enlarged view of section 10-10 shown in FIG. 9;

DETAILED DESCRIPTION OF AN EMBODIMENT

Figure 1:
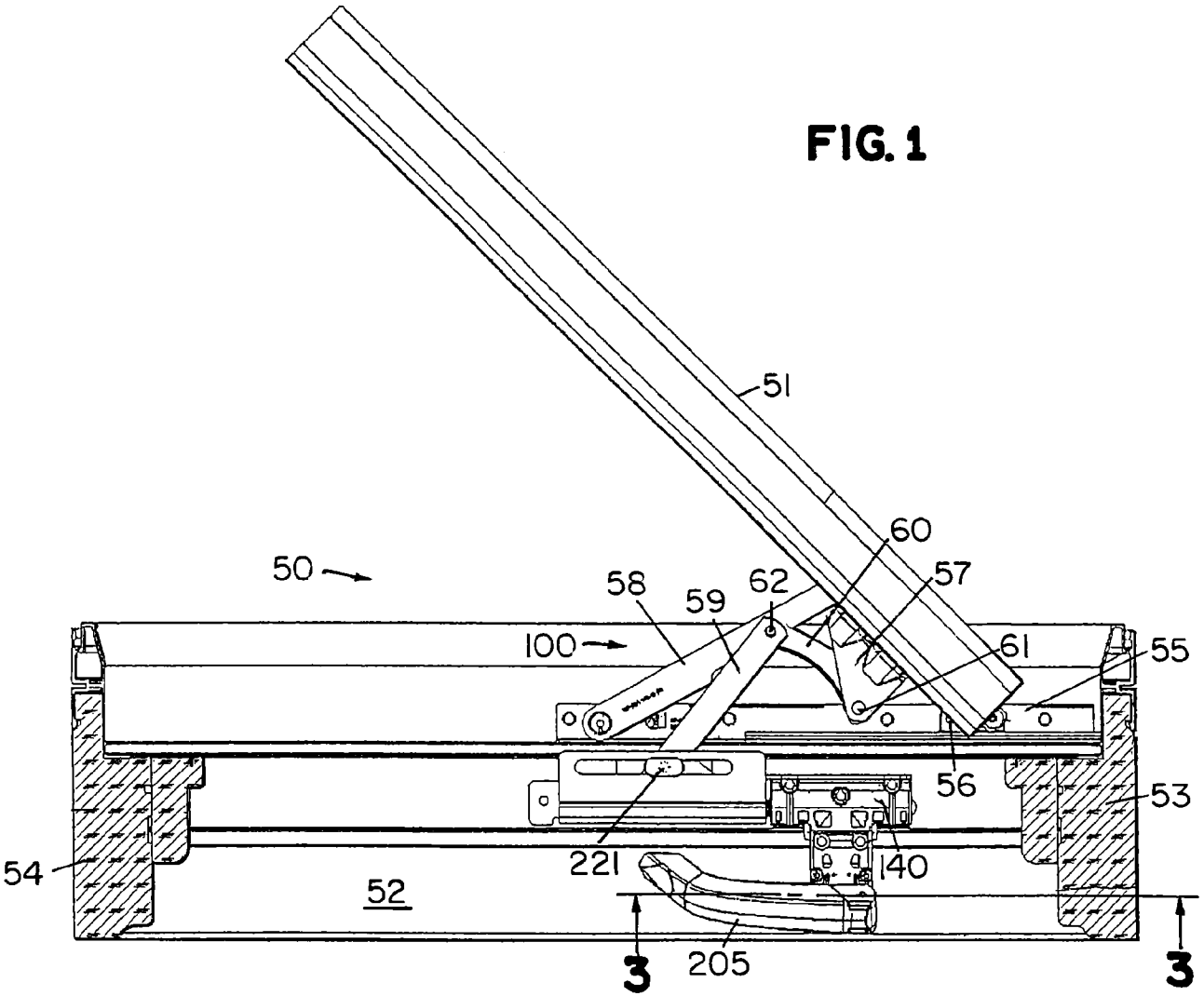
FIG. 1 is a top plan view of a split arm window operator according to the principles of the present invention installed in a window.

Referring to the drawings, wherein like numerals represent like parts throughout the several views, one embodiment of a window operator constructed according to the principles of the present invention is designated by numeral 100 in FIG. 1. The window operator 100 is shown installed in a window assembly, generally designated as 50. The window assembly 50 is a standard casement window assembly. This assembly includes a casement window sash mounted in a frame. The frame includes a bottom member 52 operatively connected to a right side member 53 and a left side member 54, by means well known in the art. Also, not shown, is a top member which would also be connected to the members 53 and 54. The window sash 51 is attached to the bottom member 52 by any suitable means, well known in the art. For instance, a track 55 is operatively connected to the bottom member 52. A shoe 56 is slideably mounted in the track 55. A sash bracket 57 is operatively connected to the sash 51. A hinge 58 has a first end pivotally connected to the track 55 and a second end operatively connected to the sash 51. A gear arm 59 is pivotally connected to a link arm 60 by a pin 62. The link arm 60 is also pivotally connected to the sash bracket 57 by a pin 61. The other end of the gear arm 59 is slideably mounted to the window operator 100, as will be more fully discussed hereafter.

A housing 140 includes a first part 141 and a second part 142. The housing 140 provides support for the lead screw 110 as well as support for a crank gear assembly 150. The crank gear assembly 150 includes four gears 151, 152, 153 and 154. The gear 153 has a first end that has a spline that is adapted and configured to receive a crank 205 as is well known in the art. The second end has a gear profile that is sized and configured to mesh with the gear profile of gear 154. At the other end of gear 154, the gear 154 has a bore that is sized and configured to receive an elongate shaft (not seen) of gear 152. The elongate shaft is hexagonal shaped as is the bore of gear 154. Splined or other connections may also be used. The gear 152 has gear tooth profile that is sized and configured to mesh with the gear profile of gear 151. The gear profile 151 has a plurality of splines around a bore that are sized and configured to mate with splines on a cylindrical member that is operatively connected to the lead screw 110. However, it is understood that other suitable driving constructions may also be utilized. A more detailed description and drawings of the housing 140, gear crank assembly 150 and the splined connection to the lead screw 110 is found in co-pending application Ser. No. 12/044,377 entitled "Lead Screw Operator", filed Mar. 7, 2008, and is hereby incorporated by reference.

Figure 2:
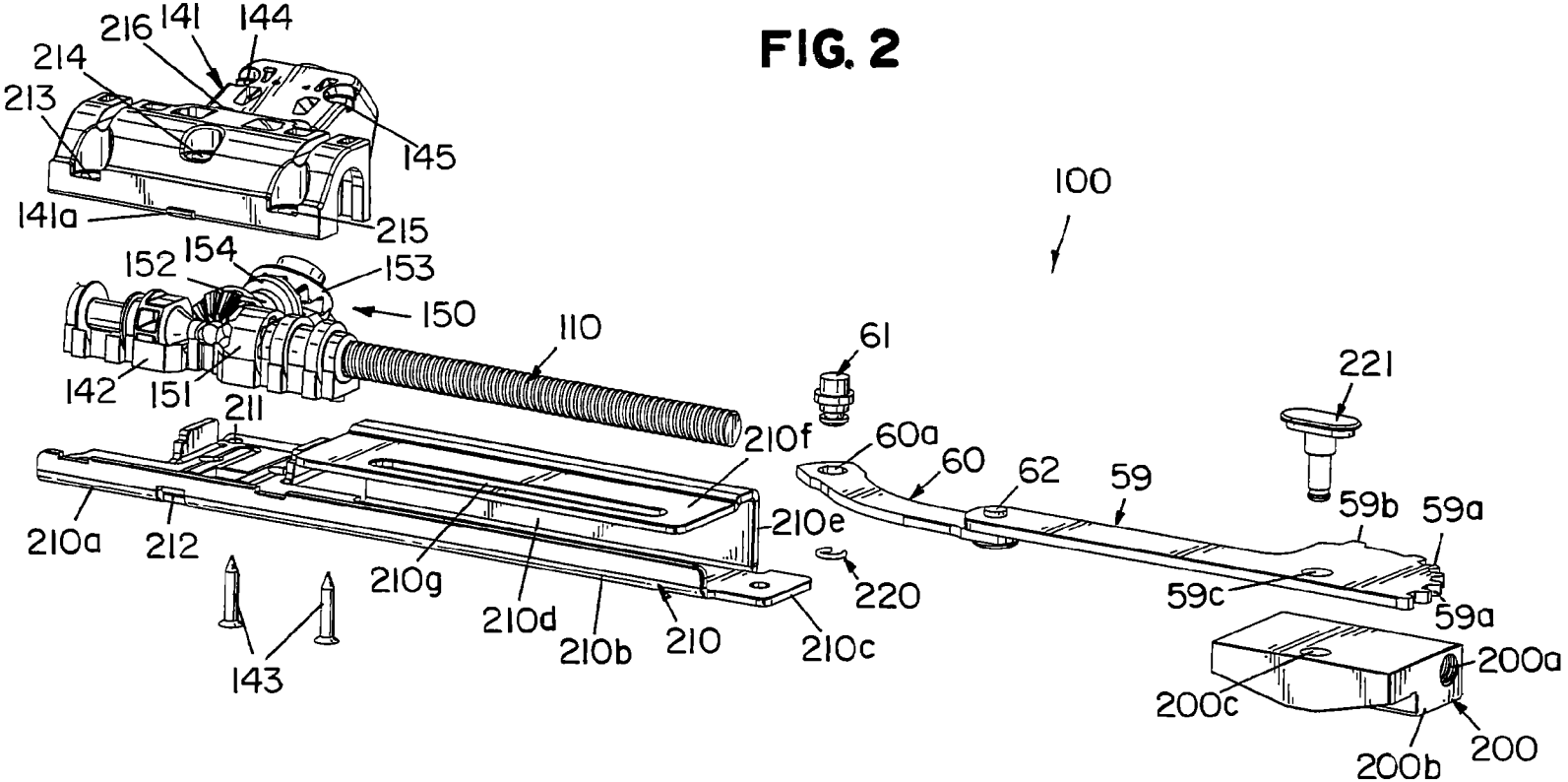
FIG. 2 is an exploded perspective view of the window operator shown in FIG. 1.
Figure 5:
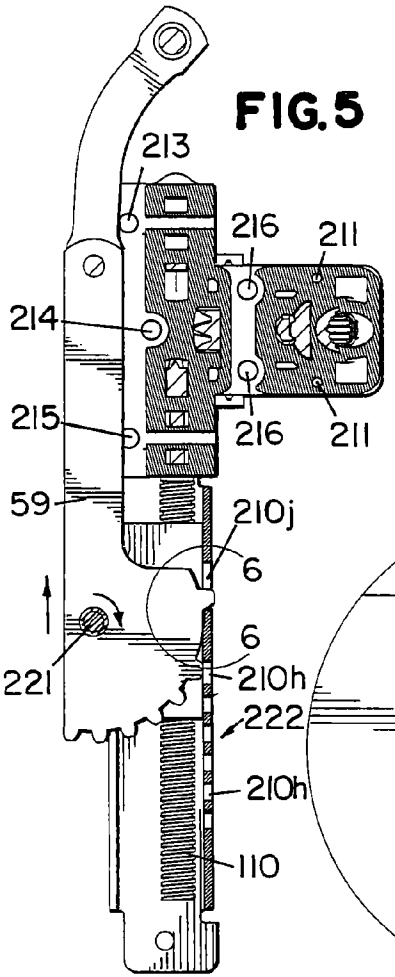
FIG. 5 is a view of the window operator shown in FIG. 3, shown in a second position.

A sliding member or nut 200 has a threaded bore 200*a* into which the threaded lead screw 110 is positioned. The nut 200 is adapted and configured to slide in a track 210. The track 210, at its left end 210*a* is operatively connected to the housing 140. Two threaded screws 143 are positioned through openings 211 in the back of the track 210. Only one of the openings 211 can be seen in FIG. 2. However, it can be seen where the pins 211 are located. Further, openings 144 and 145 are foamed in the top of the first part 141 to allow the possibility of adding a nut around the screws 143 if it is necessary to supplement the strength of the threaded openings in the first part 141. The first part 141 has a ledge 141*a* that is inserted in opening 212 to pivotally connect the first part 141 to the track 210. Screws, not shown, are also inserted in openings 213, 214 and 215 and the screws go through openings in the track and then into the frame 12. Two other openings 216, only one of which is seen in FIG. 2, but both being shown in FIG. 5, also accept screws, not shown, to further fasten the housing 140 into the frame 12.

Figure 13:
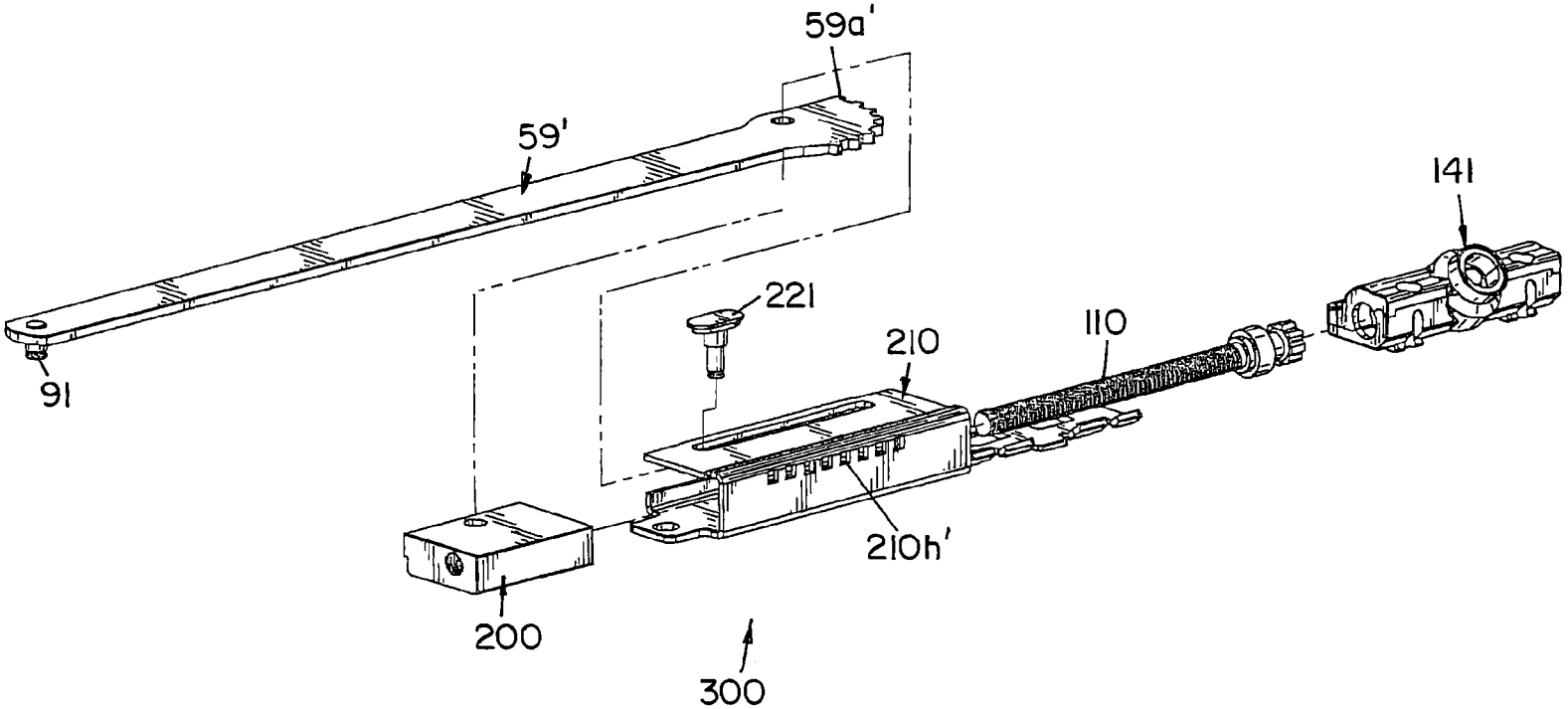
FIG. 13 is an exploded perspective view of another window operator, a straight arm operator, according to the principles of the present invention.

The right portion 210*b* of the track 210 forms a sliding portion for the nut 200. The track 210 has a bottom member 210*c* and a back member 210*d* that is operatively connected to and extends generally 90 degrees upward from the bottom member 210*c*. A front member 210*e* is operatively connected to and preferably integral with the bottom member 210*c* and extends 90 degrees upward from the bottom member 210*c*. A top member 210*f* is operatively connected to the front member 210*e* and extends generally 90 degrees away from the front member 210*e* and extends out over the back member 210*d*. An elongate slot 210*g* is formed in the top member 210*f* and also is formed in that portion of the top member 210*f* that extends beyond the back member 210*d*. The front member 210*e* has a plurality of spaced openings 210*h* that are spaced at an equal distance. A last opening 210*j* has a larger opening lengthwise and is spaced at a distance from the last hole 210*h* and is at a distance greater than the distances between the holes 210*h*. While the openings 210*h* and 210*j* are clearly shown in FIGS. 3 through 10, they cannot be seen in FIG. 2. In viewing another embodiment, as shown in FIG. 13, one can see similar openings to 210*h* and those openings are in approximately the same position as those of the openings in the embodiment shown in FIGS. 1 through 10. However, it is understood that the last opening 210*j* does not have its equivalent in the embodiment shown in FIG. 13, as will be described more fully hereafter.

The gear arm 59, as previously discussed, is pivotally connected to the link arm 60 by pin 62. The link arm 60 is pivotally connected to the sash bracket 57 by pin 61 and wire retainer 220 through opening 60*a*. The base 200*b* of the slide nut 200 has a width that is approximately equal to the distance between the back member 210*d* and the front member 210*e*. Similarly, the height of the base member 200*b* is approximately the distance between the bottom member 210*c* and the top member 210*f* minus the thickness of the gear 59. The top of the nut 200 has an opening 200*c*. The opening 200*c*, when the nut 200 is in position in the track 210, is positioned underneath the slot 210*g*. The gear arm 59 has a second end that has a plurality of spaced gear teeth 59*a*. The gear teeth 59*a* are spaced at an equal distance from each other and are spaced at the same distance as the distance between the openings 210*h*. A final gear tooth 59*b* is spaced at a further distance from the last gear tooth 59*a* than the distances between the gear teeth 59*a*. The distance between the gear teeth 59*a* and final tooth 59*b* is also the same as the distance between the last of the openings 210*h* and the last opening 210*i*. An opening 59*c* extends through the second end of the gear arm 59 and a pin 221 is inserted through the slot 210*g*, then through the opening 60*c* and secured in the opening 200*c*. It is understood that the track 210 may include a track member 210 as shown, or it could be a portion of the operator housing, or it could be some other type of connection. A different type of connection could be instead of having a track member that would encompass the nut 200, there may be a T-slot connection, dovetail connection, or other linearly moveable connection between the nut 200 and the rack 222. The rack 222 is defined by the combination of the front member 210*e*, openings 210*h* and last opening 210*i*.

Figure 3:
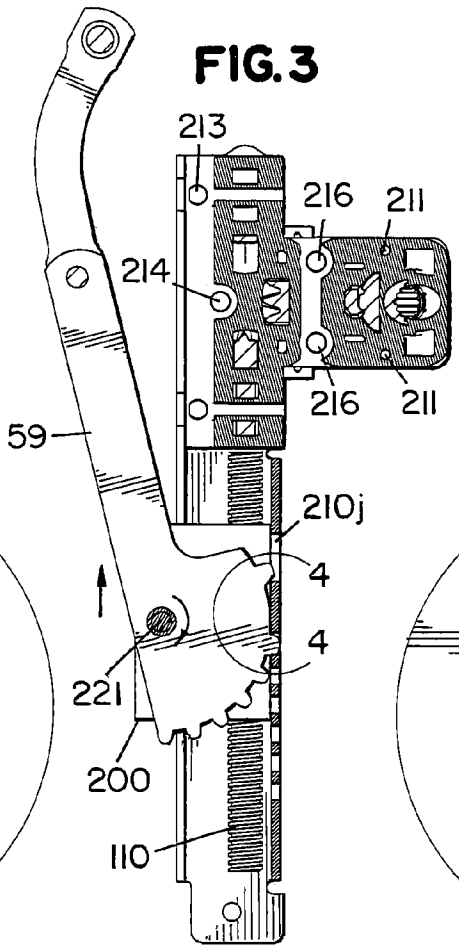
FIG. 3 is a cross-sectional view taken generally along the lines 3-3 in FIG. 1, shown in a first position.
Figure 4:
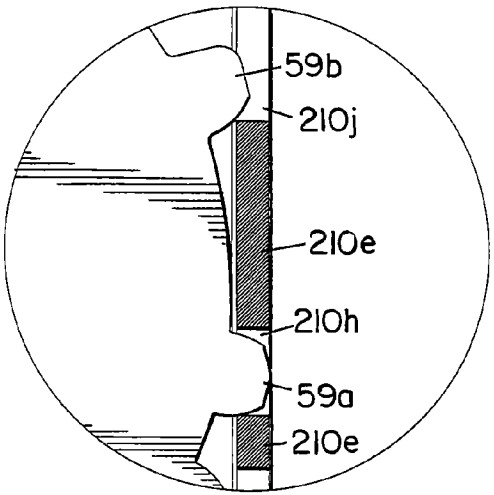
FIG. 4 is an enlarged view of section 4-4 shown in FIG. 3.

In operation, the crank 205 is rotated, which in turn rotates the gear assembly 150, as previously described, to rotate the lead screw 110. Since the lead screw 110 is stationary, with respect to longitudinal movement, the nut 200 will translate and move longitudinally along the track 210, depending upon the direction of rotation of the crank 205. FIG. 1 shows the window assembly 50 in an open position. Then, upon rotation of the crank 205, to close the window, the sequence is shown sequentially in FIGS. 3, 5, 7 and 9. The crank 205 is rotated to cause the nut 200 to move in the direction shown by the arrow in FIG. 3. The rotation of the gear arm 59 is shown by the rotational arrow shown in FIG. 3, about pin 221. An enlarged view of a portion of FIG. 3 is shown in FIG. 4, to more clearly show the interaction between the gear teeth 59*a* and gear tooth 59*b* and the rack 222. As the nut 200 slides toward the housing 140, as shown in FIG. 3, the gear arm 59 is likewise carried in this direction. This causes the teeth 59*a* to engage the rack 222, thereby resulting in rotational movement of the gear arm 59, and thereby the link arm 60 and thereby the sash, to move the sash to a closed position.

Figure 6:
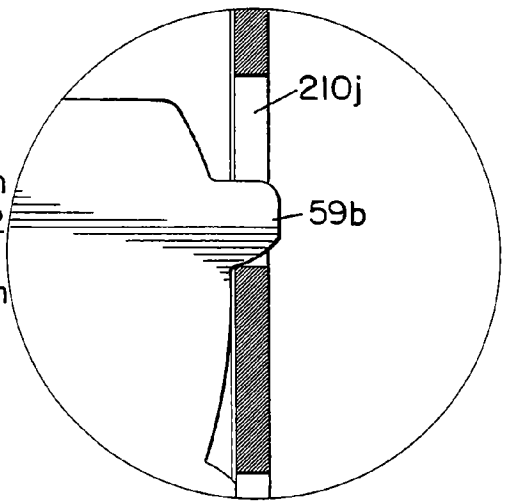
FIG. 6 is an enlarged view of section 6-6 shown in FIG. 5.

The next sequence of operation is shown in FIG. 6. There, the continued rotation of the crank 205 results in the complete rotation of the gear arm 59 and it will then cease rotation. Then, in FIGS. 7 and 9, as shown in a larger version in FIGS. 8 and 10, the crank 205 is continued to rotate and the nut 200 continues to move longitudinally toward the housing 140. However, the gear arm 59 is no longer rotating as the gear teeth are not engaging the rack 222. However, the gear arm is moving longitudinally, with the nut 200. This moves the gear tooth 59*b* into the middle of the opening 210*j* and the last gear tooth 59*a* is no longer in the opening 210*h*. This will continue to close the window 50 more tightly, without further rotation of the gear arm. Finally, FIGS. 9 and 10 show the longitudinal movement of the nut 200 completed and the gear tooth 59*b* is abutting the front member 210*e* and there is no further longitudinal movement. As can be seen in FIGS. 8 and 10, during this sequence where there is longitudinal movement, but no rotational movement, the last tooth 59*a* is positioned on top of the front member 210*e* and prevents the gear aim 59, and hence the sash 50, from opening back up, i.e., it constrains the mechanism to move straight. As best seen in FIGS. 8 and 10, the gear tooth 59*a* has a flat area that rides on front member 210*e* and spreads out the forces on the front member 210*e*. During this sequence of operation described, the pin 221 receives the force created by the gear member 59 and rack 222. During the sequence of operation shown in FIGS. 8 and 10, where there is longitudinal movement and no rotational movement, this results in a good mechanical advantage since there is no rotational movement and just longitudinal movement, to further secure the window 50 in a tight, closed position. It also allows for more tolerances during the manufacture and assembly of the window. It is understood that the gear (59 and 60) and the openings could be a mirror image and the operator driven in the opposite direction, i.e. the elongate slot 210*j* could be on the opposite end of openings 210*h* and the gear turned to correspond, to drive the operator in an opposite direction.

Figure 11:
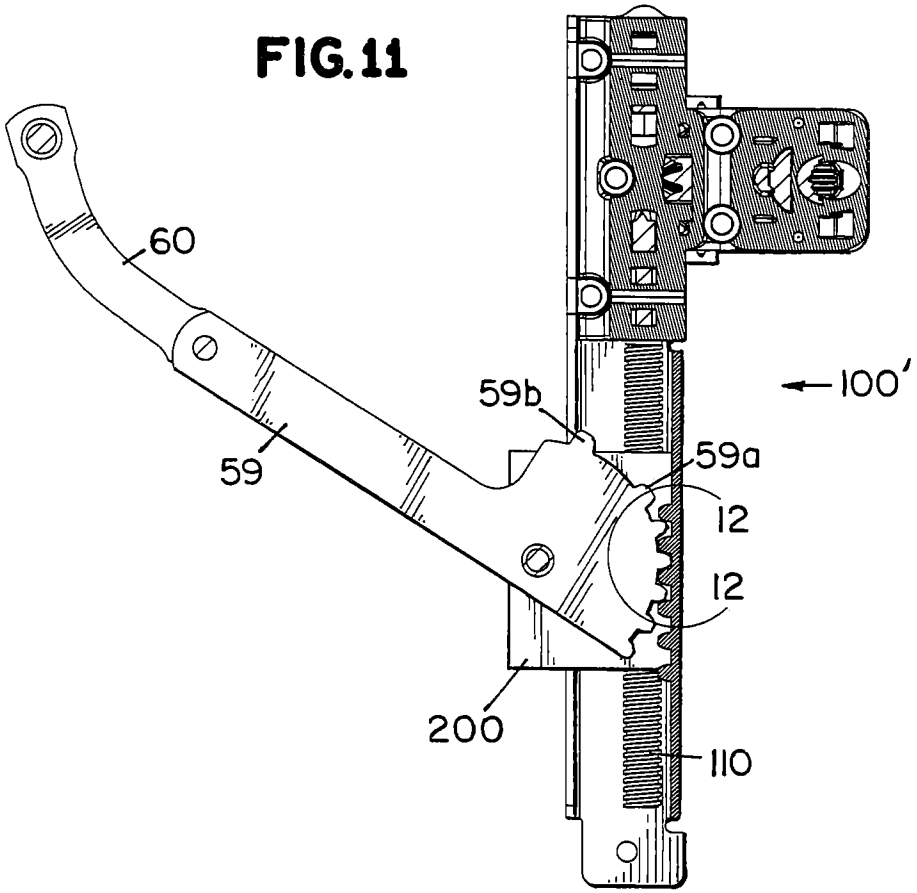
FIG. 11 is a cross-sectional view of another embodiment of a window operator, a second split arm operator, according to the principles of the present invention.
Figure 12:
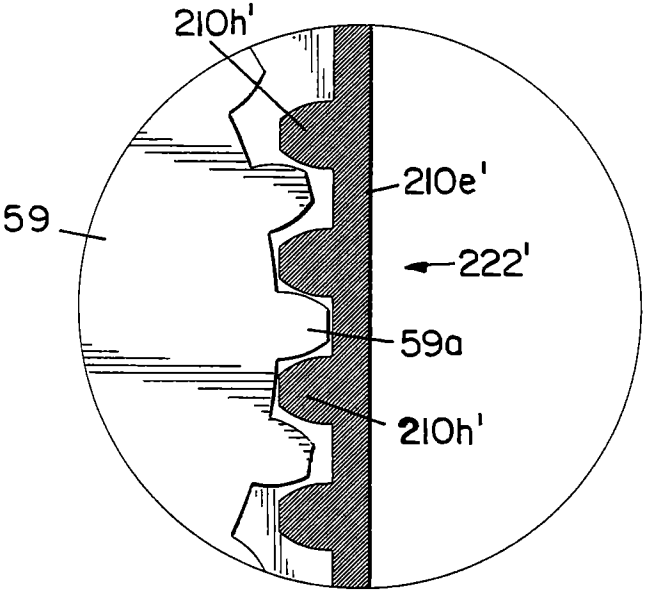
FIG. 12 is an enlarged view of section 12-12 shown in FIG. 11.

In the previously described embodiment, the rack comprised a plurality of openings in the front member 210*e*. It is also understood that protrusions could be utilized instead of openings to form a rack to interact with the gear teeth. This embodiment is shown in FIGS. 11 and 12. The window operator 100' is identical to the window operator 100 except for the construction of the rack 222'. Here, the front member 210*e'* has a plurality of protrusions 210*h'* instead of the openings 210*h* in the first embodiment. Also, there is no equivalent of the last opening 210*i* of the first embodiment shown. Although, it is understood that another protrusion could be formed from the front member 210*e* that would be spaced at a further distance to accommodate the increased distance between the gear tooth 59*b* and 59*a*. This feature is simply not shown in this embodiment but it is understood that it could be incorporated. In both embodiments shown thus far, the rack 222 and 222' is integral with the front member 210*e* or 210*e'*, although it is understood that other variations may also be utilized.

Figure 14:
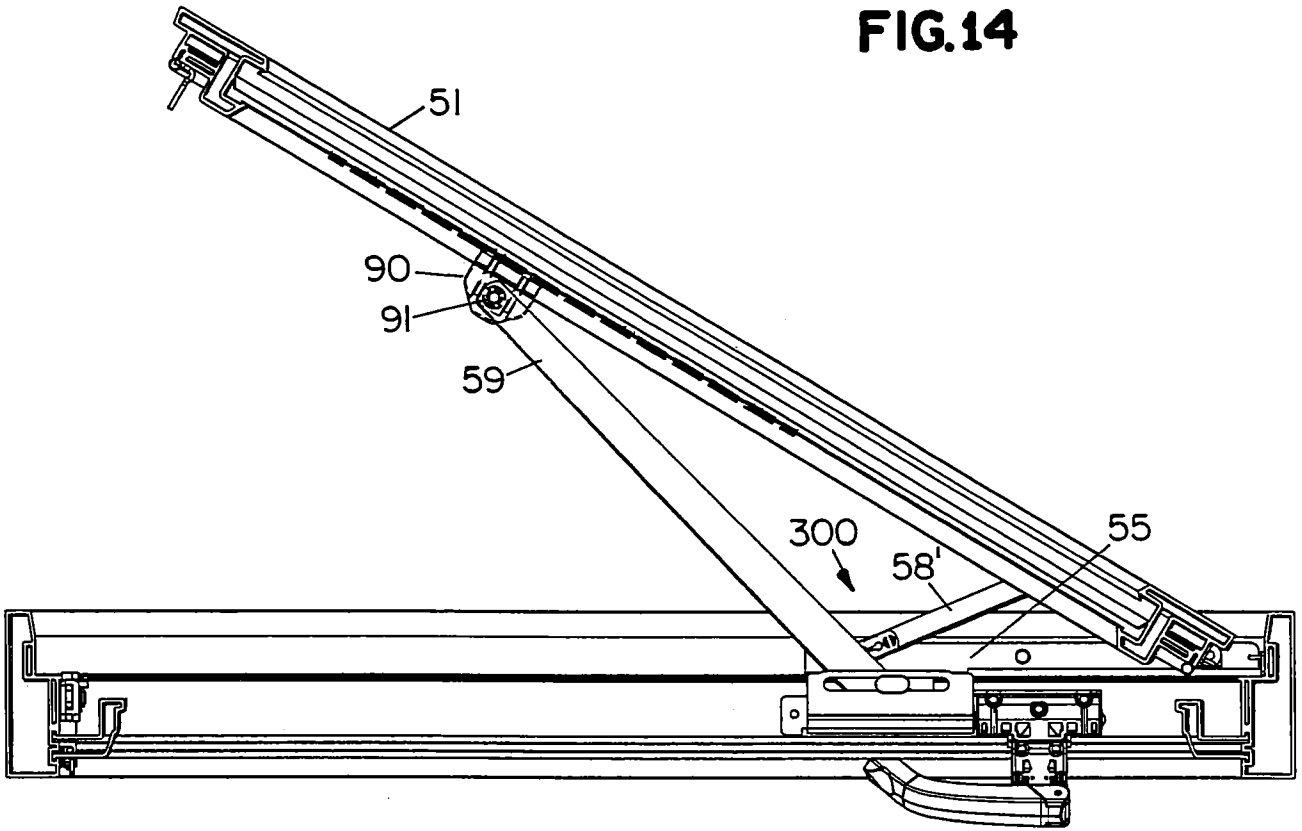
FIG. 14 is a top plan view of the operator shown in FIG. 13, installed in a window.

Another embodiment of the present invention is shown in FIGS. 13 and 14. A straight arm window operator is shown in FIG. 13 and the straight arm window operator 300 is shown attached to a sash in FIG. 14. Since the embodiment shown in FIGS. 13 and 14 is similar to the previously described embodiment in FIGS. 1 through 10, only the differences will be described in detail. Since this is a straight arm operator as opposed to a split arm operator, the gear arm 59' is a single piece as opposed to two pieces (the gear arm and link arm). The first end of the gear arm 59 is attached to a bracket 90 by a pin 91, as is well known in the art. The bracket 90 is slideably connected to the sash 51 by means well known in the art. A hinge 58' has one end operatively connected to the sash 51 and the other end to the track 55. The end of the gear arm 59*a* has a plurality of spaced gear teeth 59*a* that are similar to the spaced gear teeth 59*a*. However, there is no final gear tooth that would be the equivalent of final gear tooth 59*b*. Similarly, the openings 210*h'* are similar to the openings 210*h*. However, because there is no final gear tooth in the gear member 59', there is no need for a final opening to form the rack 222. However, it is understood that such a final gear tooth and final opening may be incorporated, although with a straight arm operator, it typically would not be necessary. The movement of the nut 200 by the lead screw 110 and rotation of the gear member 59*a* is similar and will not be described in more detail, as one skilled in the art would readily understand its operation based on the description of the first embodiment.

A final embodiment of the present invention that is shown is depicted in FIGS. 15 through 20. In the previous embodiment, the rack was stationary and the gear member moved along with the sliding member or nut. In this embodiment shown in FIGS. 15 through 20, the gear member is held in a fixed longitudinal position and the rack member moves longitudinally.

The window operator 400, as shown in FIGS. 15 through 20, utilizes a similar gear assembly and lead screw 110 as with the prior embodiments, and therefore will not be discussed in detail. Instead, the description will focus on the moveable rack 422 and longitudinally stationary gear arm 459, the rest of the operator being similar to the previously described embodiment in FIGS. 1-10, unless otherwise noted. The gear arm 459 is a straight arm operator, it being understood that the same concept could be utilized for a split arm operator. A gear pivot bracket 460 is secured to the frame 12 with suitable means such as screws 461. Alternately, the gear pivot bracket 460 could be fixed to the housing or housing track 410. The housing track 410 has a bottom portion that is generally U-shaped and is sized and configured to hold the sliding gear rack 422. The gear pivot bracket 460 has a threaded opening 460*a* in which pivot pin 462 is threadably secured. The pivot pin 462 allows the gear arm 459 to pivot. The sliding gear rack 422 has a threaded elongate opening in which the threaded lead screw 110 is positioned. The sliding gear rack has a plurality of protrusions 422*a* and valleys 422*b* which form a rack that mates with the gear teeth 459*a* around one end of the gear arm 459. The track 410 allows for a sliding engagement between the gear pivot bracket 460 and the sliding gear rack 422. However, it can be seen, especially in FIGS. 16 and 17, that a slot 422*a* and protrusion 422*b* in the gear rack 422 mate with a corresponding slot and protrusion in the gear pivot bracket 460 to aid in this sliding connection. As previously discussed with the other embodiments, other connections such as dovetails or T-slots, or the like, may be utilized.

Figure 18:
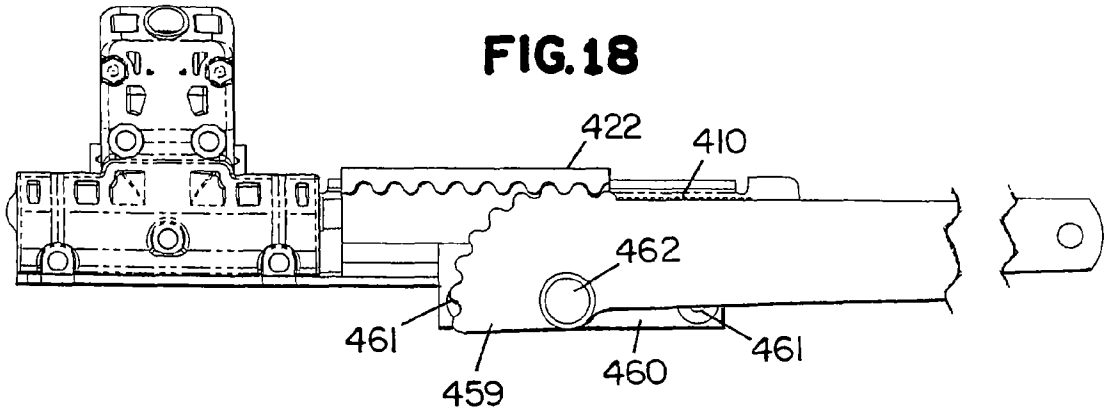
FIG. 18 is a top plan view of the window operator shown in FIG. 15, shown in a first position.
Figure 15:
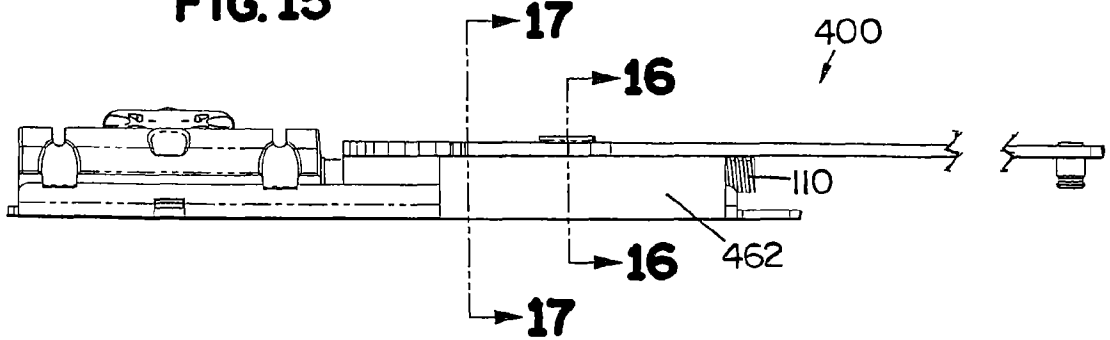
FIG. 15 is a side elevational view of another window operator, wherein the rack moves according to the principles of the present invention.
Figure 17:
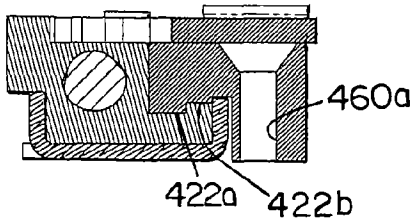
FIG. 17 is a cross-sectional view taken generally along the lines 17-17 in FIG. 15.
Figure 16:
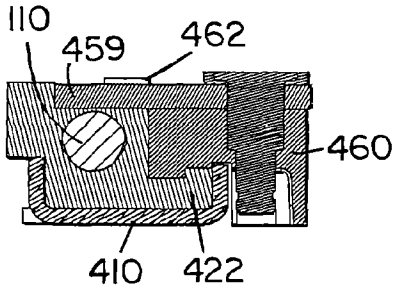
FIG. 16 is a cross-sectional view taken generally along the lines 16-16 in FIG. 15.
Figure 19:
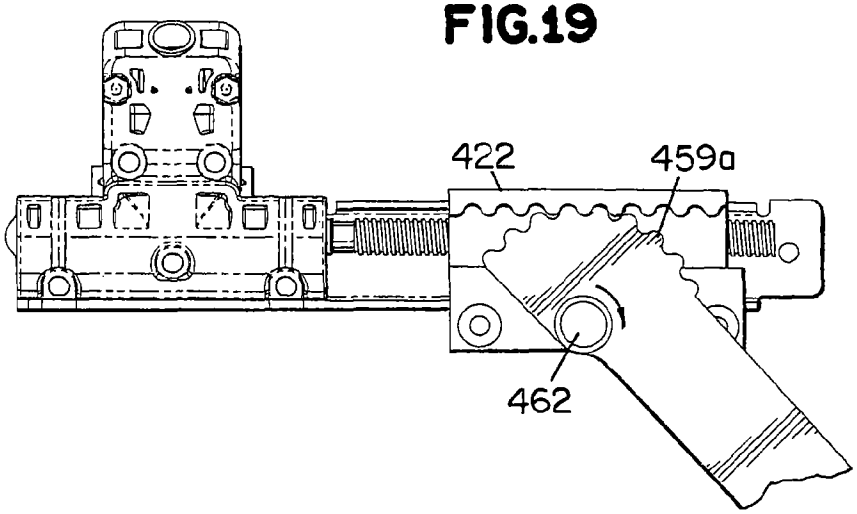
FIG. 19 is a top plan view of the window operator shown in FIG. 15, shown in a second position.
Figure 20:
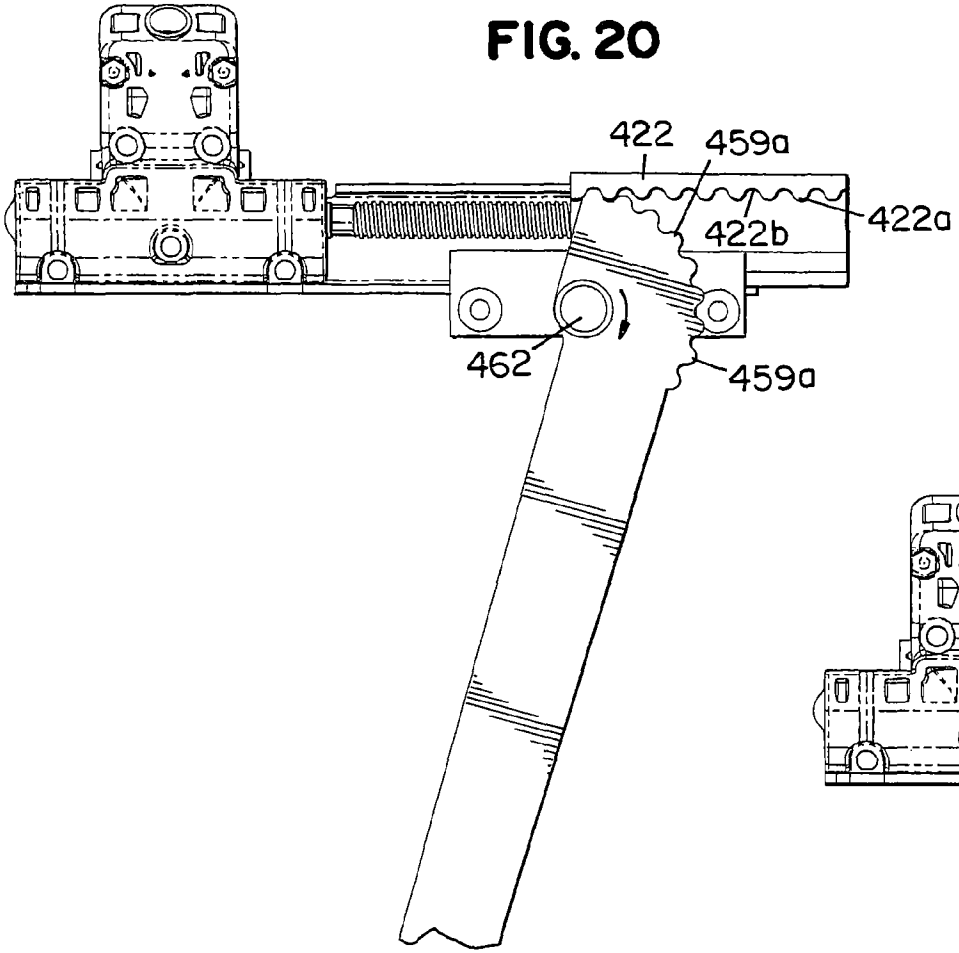
FIG. 20 is a top plan view of the window operator shown in FIG. 15, shown in a third position.

The sequence of operation from a closed position to an open position is shown sequentially in FIGS. 18 through 20. In FIG. 18, the window is shown in a closed position. Then, as a crank rotates the gear assembly, the sliding gear rack 422 moves in the direction of the arrow shown in FIG. 18. This movement causes the teeth 459*a* to engage the gear rack 422 between the protrusions 422*a* and valleys 422*b* and causes rotation in the direction shown around the pivot pin 462 by the arrow, also in FIG. 19. Then, in FIG. 20 the lead screw 110 continues to turn, driving the sliding gear rack 422 still further to the right, causing still further rotation of the gear arm 459 moving the window to a more open position. If this was incorporated into a split arm operator, it may be beneficial to include the last gear tooth and last opening design shown in the first embodiment shown in FIGS. 1 through 10.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A window operator for moving a window sash between an open and closed position relative to a fixed window frame, the window operator comprising:

a) a track member;

b) a sliding member positioned for longitudinal movement along the track member;

c) a gear member operatively connected to the sliding member, the gear member having a first end and a second end, the second end adapted and configured to be operatively connected to a window sash, the first end having a plurality of radially spaced gear teeth;

d) a rack member non-movably, fixedly connected to the track member and positioned to engage the gear teeth; and e) a drive member operatively connected to the sliding member, wherein actuation of the drive member moves the sliding member longitudinally causing the gear teeth to engage the rack member, thereby resulting in rotational movement of the gear member to move the sash between an open and closed position.

2. The window operator of claim 1, wherein the sliding member is a nut.

3. The window operator of claim 2, wherein the rack member is operatively connected to the track member.

4. The window operator of claim 3, the drive member comprising a lead screw having a screw thread and the sliding member having a threaded bore in which the screw thread is positioned, the lead screw having a driven end adapted and configured to be rotationally driven.

5. The window operator of claim 4, wherein the rack member is a plurality of longitudinally spaced openings formed in the track member.

6. The window operator of claim 1, further comprising the gear member having a first section pivotally connected to a second section, thereby forming a split arm member.

7. The window operator of claim 1, further comprising the gear member having at least a first tooth spaced from a second tooth at a first distance and the second tooth is spaced from a third tooth at a second distance, the first distance greater than the second distance, whereby at an end of a closing motion, the gear member disengages from the rack member and travels only longitudinally.

8. The window operator of claim 1, further comprising the rack member having at least a first opening spaced from a second opening at a first distance and the second opening is spaced from a third opening at a second distance, the first distance is less than the second distance, whereby at an end of a closing motion, the gear member disengages from the rack member and travels only longitudinally.

9. The window operator of claim 1, further comprising:

a) the track member having a bottom member, on which the sliding member moves, and the track member having a top member positioned over the bottom member and operatively connected thereto by a side member;

b) a longitudinal slot formed in the top member;

c) the sliding member operatively connected to the gear member by a pin; and d) the pin positioned in the slot and carried by the track member, whereby the pin receives a force created by the gear member and the rack member.

10. The window operator of claim 1, further comprising a link arm operatively connected between the second end of the gear arm and the sash.

11. A lead screw window operator for moving a sash between an open and closed position relative to a fixed window frame, the window operator comprising:

a) a track member;

b) a sliding member positioned for longitudinal movement along the track member;

c) the sliding member having a threaded longitudinal bore;

d) a gear member operatively connected to the sliding member, the gear member having a first end and a second end, the second end adapted and configured to be connected to a window sash, the first end having a plurality of radially spaced gear teeth;

e) a rack member non-movably, fixedly connected to the track member and positioned to engage the gear teeth; and f) a lead screw having an outer screw thread, the screw thread positioned in the threaded bore of the sliding member, the lead screw having a first end adapted and configured to be rotated by a gear assembly, wherein rotating the lead screw moves the sliding member longitudinally causing the gear teeth to engage the rack member, thereby resulting in rotational movement of the gear member to move a sash between an open and closed position.

12. A window operator for moving a window sash between an open and closed position relative to a fixed window frame, the window operator comprising:

a) a track member;

b) a sliding member positioned for longitudinal movement along the track member;

c) a gear member, the gear member having a first end and a second end, the second end adapted and configured to be operatively connected to a window sash, the first end having a plurality of radially spaced gear teeth, the first and second ends fixedly connected to each other by an arm;

d) a rack member non-movably connected to the track member and positioned to engage the gear teeth;

e) one of the gear member and rack member operatively connected to the sliding member, the other of the gear member and rack member positioned proximate the track member and having no longitudinal movement relative to the track member; and f) a drive member operatively connected to the sliding member, wherein actuation of the drive member moves the sliding member longitudinally causing the gear teeth to engage the rack member, thereby resulting in rotational movement of the gear member to move a sash between an open and closed position.

* * * * *